United States Patent [19]

Samuelson

[11] 4,323,261

[45] Apr. 6, 1982

[54] FRAME FOR SKATE BOARD

[76] Inventor: Harold Samuelson, 708 N. Valley Forge Rd., B-7, Lansdale, Pa. 19446

[21] Appl. No.: 169,299

[22] Filed: Jul. 16, 1980

[51] Int. Cl.[3] ..... B62D 11/00

[52] U.S. Cl. ..... 280/87.04 A; 280/12 A

[58] Field of Search ..... 280/87.04 A, 87.04 R, 280/12 A, 12 B, 12 C, 87.01; D21/227

[56] References Cited

U.S. PATENT DOCUMENTS

| | | | |
|---|---|---|---|
| 3,565,454 | 2/1971 | Stevenson | 280/87.04 A |
| 4,134,599 | 1/1979 | DiMille et al. | 280/87.01 |
| 4,160,554 | 7/1979 | Cooney | 280/87.04 A |

FOREIGN PATENT DOCUMENTS

| | | | |
|---|---|---|---|
| 558674 | 5/1923 | France | 280/87.01 |
| 80599 | 6/1934 | Sweden | 280/12 B |
| 89044 | 4/1937 | Sweden | 280/87.01 |

*Primary Examiner*—Joseph F. Peters, Jr.
*Assistant Examiner*—D. W. Underwood
*Attorney, Agent, or Firm*—Raymond Underwood

[57] ABSTRACT

A framework for removable attachment to a skate board is made up of longitudinal and transverse bars or rods fastened together in the form of a grid which is in the shape of a shallow channel.

7 Claims, 3 Drawing Figures

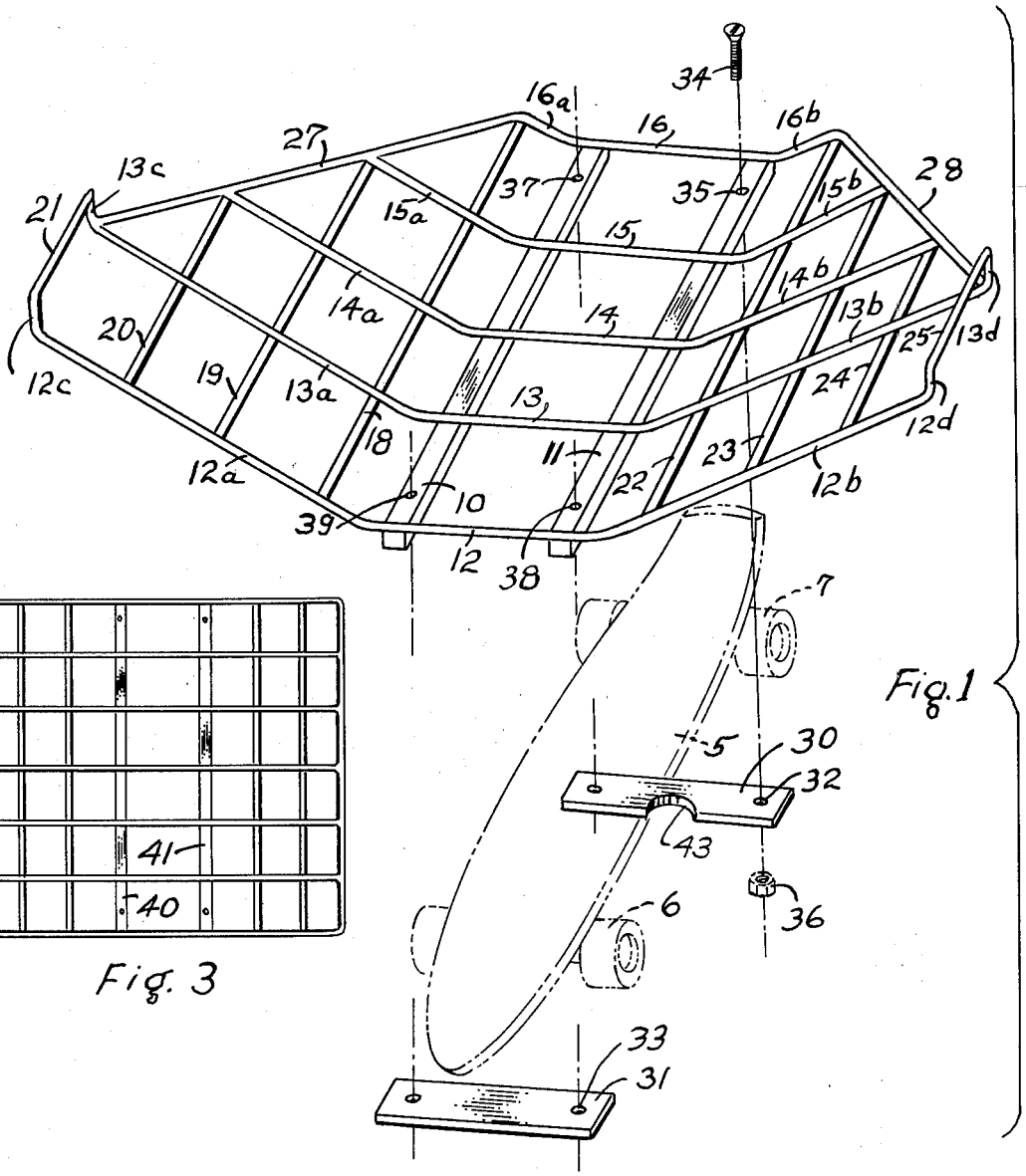
Fig. 1
Fig. 3
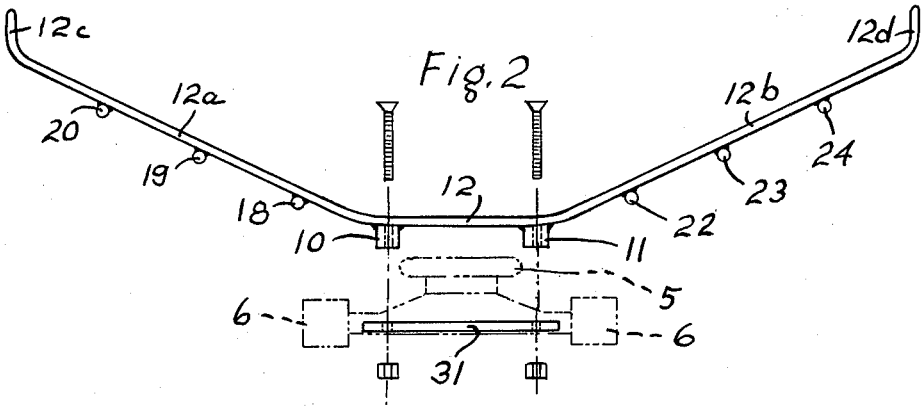
Fig. 2

FRAME FOR SKATE BOARD

This invention relates to skate boards and particularly to a framework which is to be removably attached to a skate board to hold a person on it in a reclining or a sitting position.

In recent years skate boards have become quite popular and one reason for this is their great maneuverability. The usual skate board is made up of a narrow board resembling a surf board with roller skates attached underneath each end. The roller skates are usually quite wide and a pair is at the front and a pair is at the rear. A special feature of the structure is that each pair is attached to the board by an inclined pivot which, upon a sidewise shifting of the rider's weight on the board, causes each pair to turn and guide the skates in a curved path. When the board is horizontal the wheels are in line and guide the skater in a straight path.

The wheels are provided with exceptionally frictionless, high grade ball or roller bearings so that the wheels rotate very freely and the ride is prolonged. Any momentum which is given to the skater results in a long travel motion during which the rider develops and shows his skills for controlling the maneuvers of the skate board. It is this capacity to develop a skill that accounts for the popularity of the skate board especially amoung younger persons.

Older persons and physically handicapped persons as well as very young children find themselves hindered in enjoying the full pleasure offered by the skate board. This is because it is intended that a person stand erect on the skate board and do a "balancing act" while riding on it. The inability of such nonagile persons to maintain themselves upright and lean from side to side so as to proceed in a winding pathway, curtails their rides on the skate board.

The framework of the present invention makes it possible for unsteady persons to ride on the skate board and manipulate it at will and it provides young people with a uniquely different type of ride. The framework makes it possible for the rider to lie down, crouch down or sit on the skate board and to tilt it to either side at will so as to guide it in a straight ahead or in a circuitous pathway. While doing this it is impossible for the skater to fall off of the skate board and get hurt.

A riding device which to a slight extent permits a similar type of ride is shown in U.S. Pat. No. 4,134,599 which issued to Dante DiMille and others on Jan. 16, 1979. However, its structure is entirely different from that of the present invention as it is not a framework which may be removably attached to a conventional skate board. Moreover, the patented assembly would be very expensive to manufacture whereas the present structure can be made at low cost as it uses standard materials.

Representative examples of the invention are illustrated in the accompanying drawings in which:

FIG. 1 is a perspective view showing a preferred embodiment of the invention attached to a conventional skate board, FIG. 2 is a front end elevational view of the framework, and FIG. 3 is a plan view on a reduced scale of a modification.

FIG. 1 shows a conventional skate board 5 to which the frame of the invention has been fastened. As will be explained this is a temporary attachment as the frame can easily be removed so that the skate board may be used by itself in the usual manner. To the front underside of the board 5 is attached a pair of skate wheels, one being shown at 6 and to the rear underside is attached another pair of roller skate wheels, one being shown at 7. They are attached in the usual commercial manner so that when a pair is tilted relative to the board the pair of wheels assumes an angle transverse of the board which serves to guide the direction of movement. This skate board and its attachment to the wheels forms no part of the invention and it is for this reason that its details are not illustrated.

In general, the frame of the invention is a shallow bed which has the appearance of a channel having slightly sloping sides. The bed has the overall appearance of a grid as it is made up of several parallel longitudinal bars of rods and also several parallel transverse bars or rods. The transverse bars are at right angles to the longitudinal bars. The two longitudinal bars at the center of the assembly are stronger than the others to add to the rigidity of the assembly. The details of this construction will be clarified by the following more specific description.

Rigidity and strength are imparted to the frame by the strong spaced, parallel bars 10 and 11. They are spaced far enough apart to receive between them the board 5 of the skateboard and preferably but not necessarily, this is a close fit to prevent shifting between them. This board 5 has the usual pair of front wheels 6 and the pair of rear wheels 7, attached to it in a conventional manner.

Attached as by welding to the front ends of the lengthwise or longitudinal bars 10 and 11 are the spaced, parallel bars or rods 12 and 13 which are identical to each other. The rods 12 and 13 are at right angles to the bars 10 and 11. The transverse or cross bar 12 includes an upwardly sloping portion **12*a* at one side and a like upwardly sloping portion 12*b* at the other side. The next cross rod 13 has similar side portions 13*a* and 13*b***.

Successively beyond the cross bar 13 is the cross bar 14 with its side portions **14*a* and 14*b*, the cross bar 15 with its side portions 15*a* and 15*b*, and the cross bar or rod 16 with its side portions 16*a* and 16*b*. The final cross rod 16 is attached at the ends of the longitudinal bars 10 and 11** and preferably all of these cross rods are equally spaced from each other.

The mid portions of these cross bars between the longitudinal bars 10 and 11 lie in the same plane. The side portions **12*a*, 13*a*, 14*a*, 15*a* and 16*a* all lie in a common plane which slopes upwardly and outwardly away from the bed plane of the mid portions. The side portions 12*b*, 13*b*, 14*b*, 15*b* and 16*b* all lie in a common plane which slopes upwardly and outwardly away from the bed plane of the mid portions at 12 to 16** inclusive. All of these cross rods therefore define a shallow channel.

It will be noted that the successive side portions **14*a*, 15*a* and 16*a* are progressively shorter; in like manner the successive side portions 14*b*, 15*b* and 16*b* are progressively shorter. As is clear from the above, the portions 12*a*, 12*b*, 13*a* and 13*b*** are all of the same length.

Parallel to the lengthwise bar 10 and successively located away from it are the progressively shorter 19, 20 and 21; the adjacent bar 18 could be shorter than the bar 10 but it here shown as the same length. This identical arrangement is carried out with the lengthwise rods or bars on the other side, namely 22, 23, 24 and 25 which are parallel to the longitudinal bar 11.

The rods 18, 19, 20, 22, 23 and 24 are attached by welding to the undersides of the cross rods but they may as well be attached to their top or upper sides. The terminal lengthwise rod 21 is attached, preferably to the short upturned ends 12*c* and 13*c* to provide a handle as will be explained. These end portions 12*c* and 13*c* are in a plane which is perpendicular to the plane of the mid sections 12 to 16 which form the bed of the channel. The terminal lengthwise rod 25 is like the other terminal rod 21.

The outside rod 17 extends from the end of portion 13*a* to the end of portion 16*a* and it will be noted that this slope brings it to the junction of rods 14*a* and 20 as well as at the junction of rods 15*a* and 19. Their attachments at these meeting points results in a rigid, strong construction. Additional rigidity may be imparted by adding one or more cross rods and evenly spacing them or by adding one or more longitudinal rods at each side.

To removably attach the frame on the board 5 the clamping or brace plates 30 and 31 are provided to bear against the under side of the board. The plate 30 has the two holes 32 in it and the plate 31 has the holes 33 in it. A clamping bolt 34 passes down through the hole 35 in the lengthwise bar 11 and through the hole 32 in plate 30 and the nut 36 is screwed on it. A like bolt (not shown) passes down through the hole 37 at the rear of bar 10 and through the other hole in plate 30 and a like nut is screwed on it.

Similar bolts pass through the front holes 38 and 39 and through the holes 33 in front plate 31 and their nuts are threaded on them. Obviously, an assembly of the frame on the skate board is quickly accomplished. By reversing this procedure the frame is as quickly removed from the board and the skate board is left intact for normal use.

The structure of FIGS. 1 and 2 is the preferred arrangement as the rearwardly tapered sides 27 and 28 make it easy for a person to lie down, kneel, crouch or sit on the framework between the lengthwise bars 10 and 11 and to grasp the short rods 21 and 25 which serve as handles. Shifting the weight of the person serves to guide the wheels in the same manner that is usually carried out from a standing position.

The size of the structure can be varied to fit skate boards for children and adults. In a representative structure the bars 10 and 11 could be $\frac{3}{4}$ inch by $\frac{3}{4}$ inch flat bar stock which is 20 inches long and their centers would be $6\frac{3}{4}$ inches apart. The rods or bars forming the upper grid may be $\frac{3}{4}$ inch round stock. The flat horizontal portions of the cross rods would be 10 inches long and the inclined portions 12*a* and 12*b* would be $17\frac{1}{2}$ inches long. The other dimensions are apparent from these overall measurements. The sides incline 150°–160° away from the mid section.

A variation from the preferred construction is shown in FIG. 3 as it shows that the outside construction can more or less be square. The bar 40 corresponds to the bar 10 and the bar 41 corresponds to the bar 11. This will satisfactorily hold a person but it is somewaht difficult to get onto it.

A preferred but not an essential feature is the provision of the cut-out or notch 43 in the rear clamping plate 30. It tends to stabilize the entire board which would otherwise have a natural tendency to shift off center during operation, specifically when turning. This notch engages the wheel's support and prevents sidewise slippage of the board 30.

I claim:

1. A framework for removable attachment to a skate board which comprises two spaced apart parallel bars to receive a board between them, a plurality of parallel transverse rods having their mid portions fastened to said bars to form a flat bed for a skater to ride on and having upwardly and outwardly inclined side portions to define a shallow channel, a plurality of longitudinal rods disposed parallel to said bars and connected to and tieing together the inclined portions to thereby form a grid, and means for temporarily attaching the frame to a skate board.

2. The framework of claim 1 in which the two forwardmost transverse rods are of equal lengths and their adjacent ends are connected together by a longitudinal rod to form a handle at each side.

3. The framework of claim 2 in which the outermost ends of said two foremost transverse rods are upturned to thereby elevate said handle.

4. The framework of claim 1 in which the outer sides of the frame are tapered inwardly and rearwardly.

5. The framework of claim 1 in which the outline of the grid which is formed is rectangular.

6. The framework of claim 1 in which said attachment means include a forward cross plate and a rearward cross plate to be clamped against the underside of the board.

7. The framework of claim 6 in which said bars have bolt holes through them and the cross plates have holes in them to receive clamping bolts.

* * * * *